United States Patent [19]

Valentin

[11] Patent Number: 4,519,752

[45] Date of Patent: May 28, 1985

[54] CONTROL SYSTEM FOR A VARIABLE DISPLACEMENT PUMP

[75] Inventor: Ingo Valentin, Brookfield, Wis.

[73] Assignee: Applied Power Inc., Brookfield, Wis.

[21] Appl. No.: 625,571

[22] Filed: Jun. 27, 1984

Related U.S. Application Data

[62] Division of Ser. No. 414,639, Sep. 3, 1982, abandoned.

[51] Int. Cl.[3] ..... F04B 49/02; F04B 49/08

[52] U.S. Cl. ..... 417/298; 417/270

[58] Field of Search ..... 417/298, 270

[56] References Cited

U.S. PATENT DOCUMENTS

| | | | |
|---|---|---|---|
| 2,155,236 | 4/1939 | Newell | 417/298 X |
| 2,987,003 | 6/1961 | Kress | 417/217 |
| 3,043,496 | 7/1962 | Glass et al. | 417/298 X |
| 3,303,988 | 2/1967 | Weatherhead | 417/298 |
| 3,490,683 | 1/1970 | Kocher | 417/298 |
| 3,514,222 | 5/1970 | Korotkov et al. | 417/214 |
| 3,639,082 | 2/1972 | Corwin | 417/214 |
| 3,712,758 | 1/1973 | Lech et al. | 417/214 |
| 3,738,111 | 6/1973 | Fletcher | 417/214 |
| 3,775,027 | 11/1973 | Craft | 417/214 |
| 3,844,686 | 10/1974 | LeBlanc | 417/298 |
| 3,995,973 | 12/1976 | Ring et al. | 417/214 |
| 4,060,340 | 11/1977 | Yanik et al. | 417/298 X |
| 4,371,317 | 2/1978 | Heibel | 417/298 |

FOREIGN PATENT DOCUMENTS

| | | | |
|---|---|---|---|
| 958059 | 5/1964 | United Kingdom | 417/270 |
| 494532 | 2/1976 | U.S.S.R. | 417/270 |

*Primary Examiner*—Richard E. Gluck

*Attorney, Agent, or Firm*—Andrus, Sceales, Starke & Sawall

[57] ABSTRACT

A control system for varying the volume of fluid discharged from a variable displacement hydraulic pump having a plurality of reciprocating pistons. Each piston includes an inlet check valve which controls the flow of fluid from an inlet supply line to the piston chamber, and an outlet check valve which controls the flow of fluid from the piston chamber to a discharge line. The displacement of the pump is controlled by a series of actuator members which regulate the working pressure developed by each piston by controlling the positions of the inlet check valves. Each actuator member is movable between a first position wherein it permits an inlet check valve to close and enable its corresponding piston to develop working pressure in the piston chamber, and a second position wherein it opens the inlet check valve to prevent the development of working pressure in the piston chamber. The actuator member may in one form be pilot-operated pistons or in another form be resilient elastic elements both of which are shiftable to open the inlet check valve in response to the pressure in the pump discharge line.

3 Claims, 3 Drawing Figures

CONTROL SYSTEM FOR A VARIABLE DISPLACEMENT PUMP

This application is a division of application Ser. No. 06/414,639, filed Sept. 3, 1982.

BACKGROUND OF THE INVENTION

The present invention relates to variable displacement hydraulic pumps, and more particularly to a control system for varying the displacement of reciprocating piston type pumps.

Various arrangements are known for controlling the displacement of reciprocating piston pumps. Some of these arrangements are shown in U.S. Pat. Nos. 3,995,973, 3,738,111, 3,712,758 and 2,987,003. These patents show various means for controlling pump displacement by limiting the length of the stroke of the pistons. For example, U.S. Pat. No. 3,738,111 shows a means for controlling pump displacement by controlling pressure in the drive chamber of the pump so that the pistons may operate at less than full stroke. U.S. Pat. No. 3,995,973 shows a reciprocating piston type pump having a manually movable control valve which varies the stroke length of the pistons by regulating the quantity and pressure of fluid delivered from a charge system to the inlet of the pump. It is also known to vary the eccentricity of a cam drive mechanism to alter the stroke length of the pistons.

Each of the above-described control arrangements has its advantages and disadvantages depending upon the particular application. There remains a need, however, for a control system for a variable displacement hydraulic pump which is simple in design, sensitive to system variables and provides accurate control of pump displacement over the entire operating range of the pump.

SUMMARY OF THE INVENTION

A control system for a variable displacement hydraulic pump which varies the displacement of the pump by regulating the working pressure developed in each cylinder of a reciprocating piston type pump. The working pressure developed in each cylinder is controlled by an actuator means movable between a first position wherein it permits an inlet valve means to close so that the piston develops working pressure during its power stroke, and a second position wherein it opens the inlet valve means in response to a preselected system variable to prevent the development of working pressure by the piston during its power stroke.

The actuator means includes means biasing it toward its first position to permit normal operation of the inlet valve means so that the inlet valve means closes during the power stroke and opens during the suction stroke. A pilot line applies discharge line pressure to the control member opposite the biasing means to shift the control member into its second position wherein the inlet valve means is held open during the power stroke when the force exerted by the pressure in the pilot line exceeds the force exerted by the biasing means.

The inlet valve means is a check valve having a movable stop biased toward a seated position, and the actuator means includes a movable control member having one end engageable with the stop. The control member may be a pilot piston or an elongate, resilient spring wire and both may be operated in response to the pressure in the pump discharge line. When utilizing the pilot piston, discharge line pressure is applied against its head end so that the force translated against the stop by its rod end is increased and is directly proportional to the difference in area of the head and rod ends. The pilot piston may thus be operable if desired to open the inlet check valve during either the suction or power stroke of the main piston. In contrast, the resilient spring wire is operable to open the inlet check valve only during the suction stroke. When the spring wire is shifted to its second position, i.e. its flexed position, and the main piston is in its suction stroke so that the check valve stop is unseated, the force applied against the stop is sufficient to hold the stop away from its seat during the next power stroke. Since the stop cannot reseat, the main piston cannot develop any significant working pressure.

In order to provide for step or incremental control of pump displacement, the present invention provides a control member for the inlet check valve of each main piston. Displacement is controlled by varying the spring constants of the biasing means of the inlet check valve stop and the control member for each main piston. Thus, during low pressure situations the present invention enables all check valves to operate normally to provide high fluid volume. However, as the pressure in the system increases individual inlet check valves will be sequentially disabled or opened since the pressure at that point is sufficient to overcome the spring forces applied against the control members thus providing low fluid volume operation.

The present invention thus provides a control system for varying the displacement of a hydraulic pump that is simple in design, responsive to various system variables, and accurately controls the displacement over the entire working pressure range of the pump.

BRIEF DESCRIPTION OF THE DRAWINGS

The drawings illustrate the best mode presently contemplated of carrying out the invention.

In the drawings.

DESCRIPTION OF THE PREFERRED EMBODIMENTS

Figure 1:
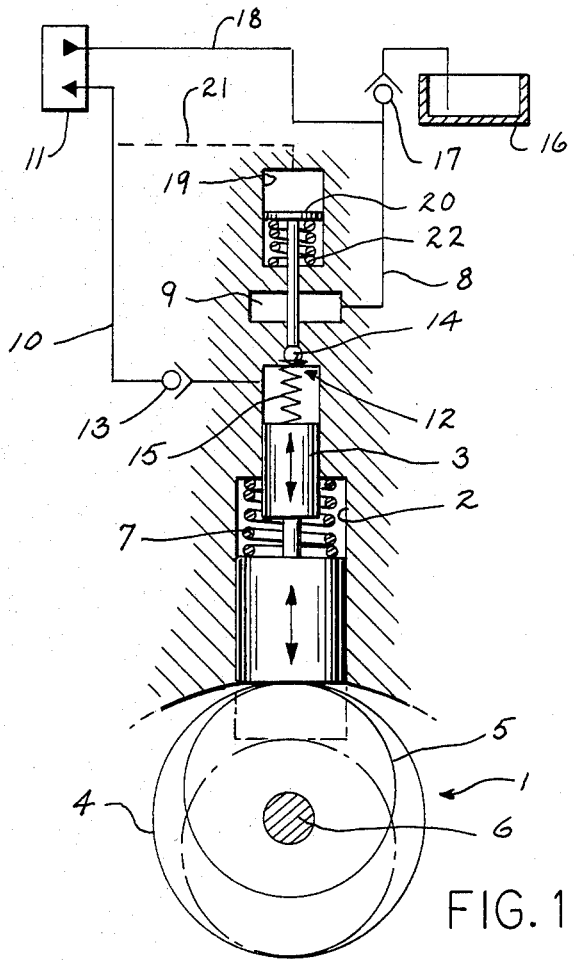
FIG. 1 is a schematic view illustrating one embodiment of the control system of the present invention which utilizes a pilot piston responsive to pump discharge pressure.

Referring now to the drawings, FIG. 1 schematically illustrates a variable displacement hydraulic pump incorporating one embodiment of the control system of the present invention. The hydraulic system includes a variable displacement radial piston hydraulic pump 1 having a plurality of radially extending and circumferentially arranged cylinders 2 with main pistons 3 mounted for reciprocation therein. It should be noted that only a single piston 3 and cylinder 2 is schematically illustrated in FIG. 1 since radial piston pumps of this type are well known in the art. The inner end of each cylinder opens into a central enclosed drive chamber 4 in which an eccentric type drive mechanism is disposed. The drive mechanism includes a rotatable eccentric 5 mounted on a shaft 6 for rotation therewith so that upon rotation of shaft 6 the eccentric 5 will rotate and engage the inner ends of the pistons 3 to force the pistons 3 outwardly through a power discharge stroke, as is well known in the art. A spring 7 is mounted in each cylinder 2 and acts between one end of cylinder 2 and its respective piston 3 to normally force the piston 3 inwardly toward the drive chamber 4 to provide a piston suction stroke, as is also well known.

The outer end of each cylinder 2 is connected to an inlet fluid supply line 8 through a reservoir 9. Each cylinder 2 is also connected to an outlet fluid discharge line 10 which supplies pressurized fluid to a hydraulic work element which is schematically illustrated as 11 in FIG. 1. The inlet line 8 and outlet line 10 have check valves 12 and 13, respectively, disposed therein which permit the flow of fluid only from the inlet line 8 to the cylinder 2 and from the cylinder 2 to the discharge line 10. As can be seen in FIG. 1, check valves 12 and 13 include a ball type stop member which permits flow of fluid in only one direction. In particular, inlet check valve 12 includes a movable ball 14 biased by a spring 15 toward a seated position. The spring 15 extends between the ball 14 and the outer end of piston 3 so that during the power stroke of piston 3 the ball 14 is in its seated or closed position to prevent the flow of fluid from cylinder 2 to the inlet line 8 and thus permit the buildup of working pressure within cylinder 2. However, during the suction stroke of piston 3 ball 14 is movable from its seated position, to an open position to permit the flow of fluid from the inlet line 8 through reservoir 9 to cylinder 2. Thus a work chamber is formed between the outer end of cylinder 2 and the outer end of piston 3 whereby during the power stroke of piston 3 fluid in the work chamber becomes highly pressurized and is forced into discharge line 10 to work element 11.

The inlet line 8 is connected to a main reservoir 16 and is conventionally provided with a check valve 17 which permits flow of fluid only from the reservoir 16 into inlet line 8. The hydraulic work element 11 is connected to the inlet line 8 by means of a return line 18 so that a closed hydraulic system is provided.

Discharge line 10 is connected by means of a pilot line 21 to an actuator means which includes a pilot cylinder 19 having a pilot operated control piston 20 slidably mounted for reciprocation therein. Piston 20 is actuatable in response to the pressure in discharge line 10 between a first position wherein it permits normal operation for the inlet check valve wherein stop member 14 is unseated during the suction stroke and seated during the power stroke so that the main piston 3 develops working pressure in cylinder 2, and a second position wherein it moves the inlet check valve stop member 14 from its seated position to its open position to prevent the development of working pressure in cylinder 2 during the piston power stroke. Piston 20 is shown in FIG. 1 in its first position and thus ball 14 is shown in its seated position. Control piston 20 includes a head end disposed within cylinder 19 and a rod end which engages ball 14. The area of the head end is greater than the area of the rod end and therefore any pressure applied against the head end is magnified at its rod end and is directly proportional to the ratio of these areas. The control piston 20 is biased toward its first position by a spring 22 which acts between one end of cylinder 19 and inner side of the head end of piston 20. The opposite or outer side of the head of piston 20 is connected to discharge line 10 by pilot line 21 which applies the discharge line pressure to the piston 20 in opposition to spring 22. When the force exerted by the pressure in pilot line 21 exceeds the spring force of spring 22 and the spring force of inlet check valve spring 15, the control piston 20 shifts to its second position wherein its rod end bears against ball 14 and moves ball 14 from its seated position to its open position to prevent the development of working pressure in cylinder 2.

In operation, when the main pump piston 3 is initially at rest as shown in FIG. 1 and eccentric 5 is rotated, piston 3 will be forced downwardly by spring 7 to create a suction effect which draws fluid from reservoir 9 past the inlet check ball 14 and into the work chamber of cylinder 2. As eccentric 5 continues to rotate it will then force piston 3 upwardly into its power stroke which causes ball 14 to move to its seated position closing off inlet check valve 12. As piston 3 continues to move upwardly in its power stroke the pressure within the work chamber of cylinder 2 continues to increase. When this pressure reaches a desired level, as determined by the spring constant of the spring in outlet check valve 13 and the area of the outlet check valve stop member, the outlet valve 13 will open to allow fluid flow to work element 11 through discharge line 10. Piston 3 then continues to move upwardly until the full piston power stroke is completed.

During the power stroke a small amount of fluid will also enter pilot line 21 and is applied against the head of control piston 20. The force developed against the head of piston 20 is opposed by springs 15 and 22. If the force developed against the head of piston 20, which is equal to pressure times control piston head area, is less than the spring force of springs 22 and 15 the flow in discharge line 10 continues. As the pressure in lines 10 and 21 increases, this correspondingly increases the force applied against the head of piston 20. If this force becomes greater than the spring force of springs 22 and 15, piston 20 will move downwardly so that its rod end bears against the inlet check valve ball 14 to open inlet check valve 12. Once opened, valve 12 will allow fluid from the cylinder 2 to flow back to reservoir 9 and thus prevent the development of working pressure in cylinder 2 so that fluid will not be forced into discharge line 10.

Figure 2:
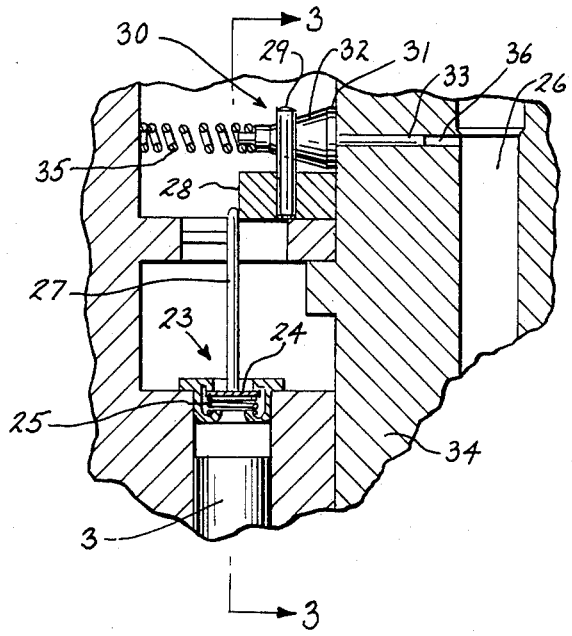
FIG. 2 is a fragmentary side view in elevation partially in section of a second embodiment of the control system of the present invention utilizing a resilient spring wire which is also responsive to pump discharge pressure.
Figure 3:
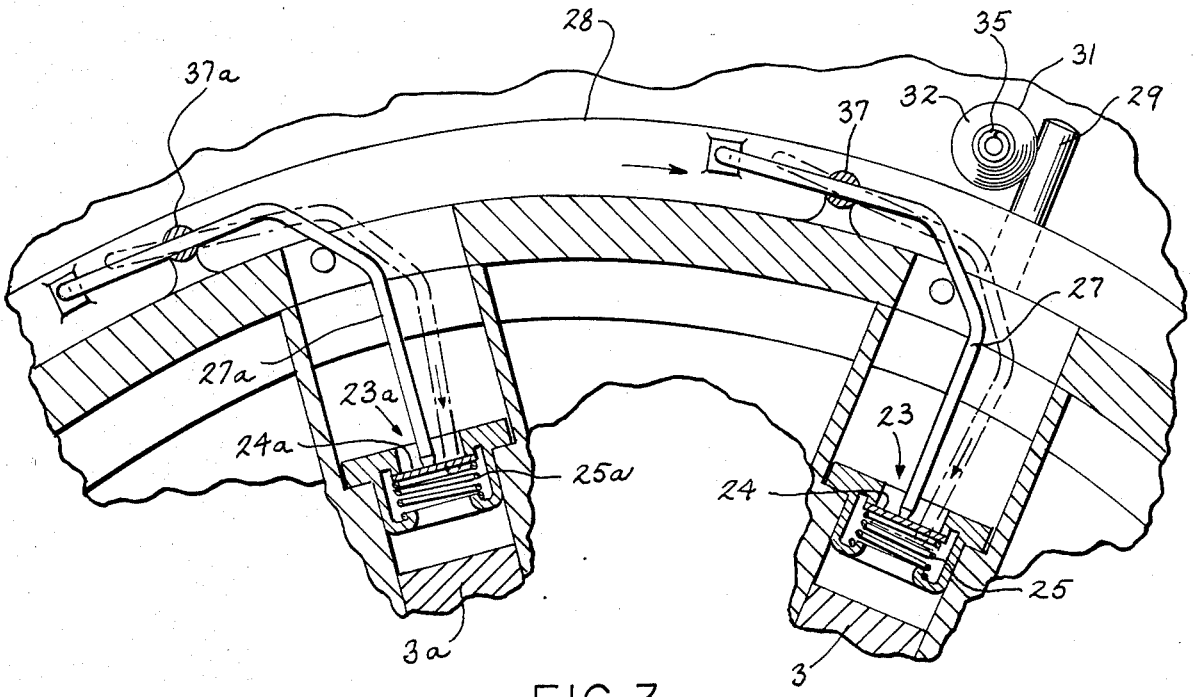
FIG. 3 is a fragmentary end view of the control system of FIG. 2.

Referring now to FIGS. 2 and 3 a second embodiment of the present invention is shown therein. It should be noted that only the material structural elements of the control system of this second embodiment are shown in FIGS. 2 and 3 since the variable displacement radial hydraulic pump has been previously thoroughly described herein.

In FIGS. 2 and 3 there is shown an inlet check valve 23 which permits the flow of fluid only from an inlet fluid supply line to a cylinder of a radially arranged piston. In this second embodiment, the inlet check valve 23 includes a stop member in the form of a flat plate 24 biased by a spring 25 towards its seated position at the outer ends of the cylinders. Check valve 23 operates in the same manner as previously described for check valve 12 of the first embodiment so that during the piston suction stroke plate 24 is drawn downwardly against the force of spring 25 to an open or unseated position to permit the flow of fluid into the working chamber of the cylinder. During the piston stroke plate 24 moves against its seat closing off valve 23 so that pressure within the cylinder increases until an outlet valve (not shown) opens to allow fluid flow through a discharge line 26.

As a means for controlling or varying the volume of fluid discharged, the pump includes an actuator means movable in response to the pressure in discharge line 26 between a first position wherein it permits normal operation of the inlet check valve 23 wherein it closes during the power stroke so that the piston develops working pressure in its cylinder, and a second position wherein it opens the inlet check valve 23 to prevent the development of working pressure in its cylinder. The actuator means includes a resilient actuator member in the form of an elongated, resilient spring wire 27 having one end engageable with the plate 24 of inlet check valve 23 and its other end mounted on a movable support means. As seen best in FIG. 3, the upper end of wire 27 is slidably mounted within a stationary guide member 37 the purpose of which will hereinafter be described. The support means includes a rotatable axially extending annular ring 28 disposed about the radially outer ends of each piston and cylinder arrangement. Although only one spring wire 27 is shown in FIGS. 2 and 3 it will be readily obvious to those skilled in the art that there are a plurality of circumferentially spaced apart resilient spring wires disposed equi-angularly about the ring 28 and mounted thereon so that each spring wire controls the inlet check valve of a corresponding cylinder of a radial piston pump. The ring 28 is biased by a spring (not shown) which forces the ring 28 into a position wherein the spring wire 27 is in its first position whereby it permits normal operation of the inlet check valve. As seen best in FIG. 2, a pin 29 is mounted on ring 28 and extends radially outwardly therefrom.

As a means for moving or rotating ring 28 there is provided a pilot-operated plunger 30 engagable with the pin 29. Plunger 30 is shiftable between a first position which is shown in FIG. 2 wherein the spring wire 27 is in its non-actuated position whereby it permits normal operation of the inlet check valve 23, and a second position wherein the plunger 30 rotates ring 28 and thus moves spring wire 27 into its actuated position to open inlet check valve 23. Plunger 30 includes a cone-shaped head 31 having an inclined surface 32 formed thereon and a stem 33 slidably mounted within a pump manifold 34. As shown in FIG. 2, plunger 30 is positioned to shift in an axial direction with respect to the radially disposed cylinders and pistons of the pump. Plunger 30 is biased toward its first position by a spring 35 which acts on one end, i.e. the head 31 of plunger 30, while the opposite end, i.e. the stem 33 of plunger 30, is connected to the discharge line 26 by a pilot line 36. Pilot line 36 applies the discharge pressure to the stem 33 of plunger 30 in opposition to the force of spring 35. Thus, when the force exerted by the pressure in pilot line 36 exceeds the spring force of spring 35, plunger 30 shifts to the left as seen in FIG. 2. When plunger 30 shifts its inclined surface 32 engages pin 29 forcing the ring 28 to rotate and thus move spring wire 27 to engage plate 24 of check valve 23.

In operation, a piston suction stroke causes plate 24 of inlet valve 23 to open so that hydraulic fluid may be drawn into the cylinder work chamber. When the piston begins its power stroke, plate 24 moves against its seat closing off inlet check valve 23. As the piston continues to move the pressure within the work chamber continues to increase until it reaches a desired level as determined by the outlet check valve (not shown). At this point the outlet check valve will open to allow fluid flow through discharge line 26 to a work element.

A small amount of fluid enters pilot line 36 from discharge line 26 and is applied against the stem 33 of plunger 30. The force developed at this stem 33 is opposed by the spring 35 and the spring which biases the ring 28 into its initial position. If the force applied against stem 33 is less than these spring forces, the flow through discharge line 26 continues. As the pressure in discharge line 26 increases, the pressure in pilot line 36 increases which in turn increases the force applied against stem 33. Once the force applied against stem 33 becomes greater than the spring forces opposing it, plunger 30 will move to the left as shown in FIG. 2 so that its inclined surface 31 engages pin 29 and rotates ring 28. Rotation of ring 28 moves spring wire 27 to the right as seen in FIG. 3. The upper end of spring wire 27 slides through the opening in guide member 37 causing spring wire 27 to flex wherein it applies a force against the inlet check valve plate 24. The force applied against plate 24 is not sufficient to overcome the seating force acting on plate 24 due to the pumping effect of the piston during its power stroke. Thus, the force applied against plate 24 is stored as a displacement in the resilient spring wire 27. Once the piston begins its suction stroke, however, plate 24 of check valve 23 will once again open to allow fluid to be drawn into its cylinder. When plate 24 opens, spring wire 27 returns to its unflexed state with its tip engaged aginst the outer face of plate 24, as shown in dotted lines in FIG. 3. Although as previously noted the force applied by spring wire 27 against plate 24 is not sufficient to overcome the seating force acting on plate 24 during the power stroke of the piston this force is sufficient to hold plate 24 away from its seated position once plate 24 has been shifted during the suction stroke of the piston. As a result, plate 24 cannot reseat itself during the next successive power stroke of the piston. Thus, the piston cannot develop any significant working pressure in its cylinder to open the outlet check valve and fluid will not be pumped into discharge line 26.

It should be noted that in the first embodiment shown in FIG. 1 as well as the second embodiment shown in FIG. 2 there has been shown only a single piston and cylinder arrangement. However, as is readily obvious to those skilled in the art pumps such as radial piston pumps have a plurality of reciprocating pistons and have a plurality of inlet and outlet check valves controlling the flow of fluid to and from each cylinder. Thus it will be necessary to provide a control piston 20 or a spring wire 27 for each piston and cylinder arrangement. For purposes of clarity, however, only the control system for one piston and cylinder arrangement has been shown for each embodiment in FIGS. 1 and 2. FIG. 3, however, illustrates a second radial piston **3*a* and check valve 23*a* having a plate 24*a* and spring 25*a* together with a corresponding second spring wire 27*a* guided in member 37*a* and circumferentially spaced from spring wire 27 on ring 28. It is thus necessary to preselect the spring constants of springs 15 and 22 of the embodiment shown in FIG. 1 and of springs 25 and 35 of the second embodiment shown in FIGS. 2 and 3** so that they will enable normal operation for all of the inlet check valves during low pressure/high volume situations, as for example when advancing a hydraulic cylinder from its rest position to a point of contact. However, as the pressure in the system increases individual inlet check valves will become sequentially disabled since the pressure, as it increases, is sufficient to sequentially overcome the different spring forces for each inlet check valve.

It should be noted that while the pump 1 is illustrated as a radial piston pump, this is only for purposes of illustration since other reciprocating piston type pumps such as an axial piston pumps would be equally suitable for use with the control system of the present invention. In addition, it should also be noted that while the control system has been described as being responsive to discharge line pressure it is readily obvious that the control pistons 20 or the spring wires 27 may be responsive to any preselected variable, not necessarily pressure. For example, the pistons 20 and spring wires 27 may be shifted in response to the change in RPM of the pump motor which rotates shaft 6.

Various modes of carrying out the invention are contemplated as being within the scope of the following claims particularly pointing out and distinctly claiming the suject matter which is regarded as the invention.

I claim:

1. A hydraulic system, comprising a variable displacement hydraulic pump having a cylinder communicating with an inlet fluid supply line and an outlet fluid discharge line, a reciprocating main piston element disposed in said cylinder having a suction stroke wherein fluid enters the cylinder from the inlet line and a power stroke for pumping fluid from the cylinder into the discharge line; inlet check valve means for controlling the flow of fluid from the inlet line to the cylinder, said inlet check valve means includes a movable valve stop member biased toward a seated position to prevent the flow of fluid from the cylinder to the inlet line during said power stroke and movable from its seated position to an open position to permit the flow of fluid from the inlet line to the cylinder during said suction stroke; outlet check valve means for controlling the flow of fluid from the cylinder to the discharge line; and control means for varying the volume of fluid discharged, said control means includes a resilient actuator member movable in response to a preselected system variable between a first unflexed position wherein it permits the inlet check valve stop member to seat so that the main piston element develops working pressure in the cylinder, and a second flexed position wherein it applies a force against the inlet check valve stop member, said force being sufficient to hold the inlet valve stop member off its seat in its open position after said stop member is opened during the piston suction stroke to prevent the development of working pressure in the cylinder during the piston power stroke, said actuator member is mounted on a movable support means, and further including means for moving said support means whereby said actuator member is moved between its first and second positions, said moving means includes a pilot-operated plunger engageable with said support means and shiftable between a first position wherein said actuator member is in its first position, and a second position wherein said actuator member is in its second position; means for biasing the plunger toward its first position; and a pilot line between the pump discharge line and the plunger for applying discharge line pressure to the plunger opposite the biasing means to shift the plunger into its second position when the force exerted by the pilot line pressure exceeds the force exerted by the biasing means, and said pump is a radial piston pump having a plurality of radially disposed reciprocating piston elements and a plurality of inlet check valve means controlling the flow of fluid to each piston cylinder, and said support means includes a rotatable ring having a plurality of circumferentially spaced apart resilient members mounted thereto for controlling the position of each of said inlet check valves.

2. The system of claim 1, wherein said ring further includes a pin mounted thereon and extending radially outwardly therefrom, and said plunger is movable in an axial direction and includes an inclined surface engageable with said pin to rotate said ring.

3. The system of claim 1, wherein said resilient members are elongated spring wires.

* * * * *